US006910953B2

(12) United States Patent
Allaire et al.

(10) Patent No.: US 6,910,953 B2
(45) Date of Patent: Jun. 28, 2005

(54) METHODS AND APPARATUS FOR EDGE FINISHING GLASS SHEETS

(75) Inventors: Roger A. Allaire, Big Flats, NY (US); James W. Brown, Painted Post, NY (US); Clive D. Gierbolini, Painted Post, NY (US); Robert G. Schaeffler, Pine City, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 10/626,310

(22) Filed: Jul. 24, 2003

(65) Prior Publication Data

US 2005/0020193 A1 Jan. 27, 2005

(51) Int. Cl.[7] ..... B24B 1/00
(52) U.S. Cl. ..... 451/44; 451/296
(58) Field of Search ..... 451/44, 42, 43, 451/168, 174, 296, 297, 298, 303, 304, 310

(56) References Cited

U.S. PATENT DOCUMENTS

| | | | | |
|---|---|---|---|---|
| 2,332,329 A | | 10/1943 | Maca | |
| 2,706,876 A | | 4/1955 | Levengood | |
| 2,969,624 A | | 1/1961 | Buckler et al. | |
| 5,868,857 A | | 2/1999 | Moinpour et al. | |
| 5,961,372 A | | 10/1999 | Shendon | |
| 5,975,992 A | | 11/1999 | Raeder et al. | 451/44 |
| 6,231,429 B1 | | 5/2001 | Lisec | |
| 6,357,071 B2 | | 3/2002 | Moinpour et al. | |
| 6,428,390 B1 | * | 8/2002 | Clark et al. | 451/11 |
| 6,609,956 B2 | * | 8/2003 | Margaria | 451/44 |
| 6,685,541 B2 | * | 2/2004 | Brown et al. | 451/41 |

FOREIGN PATENT DOCUMENTS

| | | |
|---|---|---|
| DE | 1652060 | 10/1967 |
| EP | 1 060 833 A1 | 12/2000 |
| JP | 58217264 | 12/1983 |

* cited by examiner

*Primary Examiner*—Dung Van Nguyen
(74) *Attorney, Agent, or Firm*—Joanne N. Pappas

(57) ABSTRACT

A rotating belt (10) is used to finish the edges (23) of glass sheets (11), such as, the thin sheets (e.g., 0.7 mm) used as substrates for liquid crystal displays (LCDs). The edge (23) of the sheet (11) engages the working zone (15) of the belt (10) along a line segment (17) whose included angle with the direction of motion (19) of the belt (10) is less than 10°. The working zone (15) is brought into contact with the edge (23) by a pressure sensitive platen (13) which can accommodate errors in the positioning of the sheet (11) at the finishing station (12).

33 Claims, 11 Drawing Sheets

PRIOR ART

A side Apex B side

METHODS AND APPARATUS FOR EDGE FINISHING GLASS SHEETS

FIELD OF THE INVENTION

This invention relates to edge finishing of glass sheets and, in particular, to edge finishing of thin glass sheets of the type used as substrates for liquid crystal displays (LCDs).

BACKGROUND OF THE INVENTION

In the manufacture of LCD substrates, a sizing procedure is used in which a large sheet of glass is scored and separated into smaller glass sheets having a size suitable for further processing into displays. To ensure that these smaller glass sheets have sufficient strength to withstand the display manufacturing process with minimal levels of breakage, the edges of the scored and separated pieces are given a rounded profile of the type shown in FIG. 1.

At present, this profile is obtained using a metal-bonded diamond grinding wheel. Such wheels include a groove which contacts the scored edge of the glass sheet and grinds the edge until it has the profile of FIG. 1. The process and equipment associated with the use of such wheels requires the removal of a minimum of 200 microns of glass per edge to assure proper processing. This amount of removal is necessitated by such factors as system misalignment and machine conveying accuracy through the grinding operation.

The existing wheel-based grinding technology thus applies a substantial grinding load to the glass during the finishing process. It also reduces the speed at which that process can operate and still maintain acceptable quality levels. There thus exists a need in the art for edge finishing methods and apparatus which overcome these deficits in the current technology.

DESCRIPTION OF THE PRIOR ART

Levengood, U.S. Pat. No. 2,706,876, and Lisec, U.S. Pat. No. 6,231,429, show the use of a rotating belt to grind the edge of a glass sheet. Significantly, with regard to the present invention, the direction of rotation of the belt in these patents is transverse to the axis of the glass edge. Such transverse grinding has been found to result in high levels of glass' chipping due to, among other things, contact between the belt's seam and the glass' edge. This is particularly a problem when used with thin sheets of glass of the type employed as substrates in liquid crystal displays, e.g., glass sheets having a thickness of 0.7 millimeters or less.

As discussed and illustrated fully below, in accordance with the present invention, the direction of rotation of the belt is along the axis of the edge. In practice, this has been found to essentially completely eliminate the breakage problem caused by the belt's seam.

In certain preferred embodiments of the invention, the along-the-edge motion of the belt is combined with controlled motion of the belt's working zone with respect to the glass's edge. In particular, the spatial orientation of the belt's working zone is controlled in three dimensions during the finishing process. Such spatial orientation of the working zone allows the rotating belt to (1) conform to misalignments of the glass' edge and (2) produce a profile of a desired configuration, e.g., a configuration of the type shown in FIG. 1. The Levengood and Lisec patents also do not disclose these aspects of the present invention.

SUMMARY OF THE INVENTION

The present invention provides methods and apparatus for finishing the edge of a glass sheet and, in particular, for finishing a linear edge of a glass sheet. As used in this specification and in the claims, the phrase "finishing the edge of a glass sheet" and similar phrases, e.g., "edge finishing," includes edge grinding, edge polishing, or both, and the phrase "linear edge of a glass sheet" means an edge in the form of a straight line as opposed to an edge that is curved.

In accordance with a first aspect, the invention provides a method for finishing a linear edge (23) of a glass sheet (11) comprising:

(a) providing a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) rotating the belt (10) so that in the working zone (15), the outer surface of the belt moves in a predetermined direction (19); and (c) finishing said linear edge (23) of the glass sheet (11) by:

(i) bringing the outer surface of the belt (10) and the linear edge (23) into contact to form a line segment of contact (17) between the surface and the linear edge (23), said line segment of contact (17) being in the working zone (15); and (ii) removing glass from the linear edge (23) by maintaining the linear edge in contact with the surface;

wherein the line segment of contact (17) and the predetermined direction (19) have an included angle (e.g., angle $\epsilon$ in FIG. 2) of less than 10 degrees.

In accordance with a second aspect, the invention provides a method for finishing a linear edge (23) of a glass sheet (11) comprising:

(a) providing a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) rotating the belt (10); and (c) finishing said linear edge (23) of the glass sheet (11) by:

(i) bringing the outer surface of the belt (10) and the linear edge (23) into contact to form a line segment of contact (17) between the surface and the linear edge (23), said line segment of contact (17) being in the working zone (15); and (ii) removing glass from the linear edge (23) by maintaining the linear edge in contact with the surface;

wherein:

(i) the glass sheet (11) and the working zone (15) each define a plane (e.g., the Y-Z plane for the glass sheet and the x-z plane for the working zone for $\alpha$=0 in FIG. 7);

(ii) said planes intersect at a line which contains the line segment of contact (17); and (iii) the plane of the working zone (15) has at least two orientations with respect to the plane of the glass sheet (11) during step (c)(ii).

In accordance with a third aspect, the invention provides a method for finishing a linear edge (23) of a glass sheet (11) comprising:

(a) providing a belt assembly (10, 13, 27) which comprises:

(i) a rotating belt (10) having an outer surface for removing glass from the linear edge (23) and an inner surface; and (ii) a platen (13) which contacts the belt's inner surface; and (b) finishing said linear edge (23) of the glass sheet (11) by:

(i) bringing the outer surface of the belt (10) and the linear edge (23) into contact by moving the platen (13) towards the linear edge (23); and (ii) removing glass from the linear edge (23) by maintaining the linear edge in contact with the surface;

wherein:

(i) the glass sheet (11) lies in the Y-Z plane of an X,Y,Z coordinate system;

(ii) prior to being contacted by the outer surface of the belt in step (b)(i), the linear edge (23) has an orientation whereby it is either parallel to or at angle (e.g., angle $\alpha$ in FIG. 7) to the Z-axis of the X,Y,Z coordinate system; and (iii) the platen (13) adopts said orientation of the linear edge (23) as the outer surface of the belt (10) comes into contact with the linear edge (23) during step (b)(i).

In accordance with a fourth aspect, the invention provides a method for finishing a linear edge (23) of a glass sheet (11) comprising:

(a) providing a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) rotating the belt (10); and (c) finishing said linear edge (23) of the glass sheet (11) by:

(i) bringing the outer surface of the belt (10) and the linear edge (23) into contact to form a line segment of contact (17) between the surface and the linear edge (23), said line segment of contact being in the working zone (15); and (ii) removing glass from the linear edge (23) by maintaining the linear edge in contact with the surface;

wherein:

(i) the working zone (15) has a centerline (e.g., a centerline which falls on line 19 in FIG. 2); and (ii) during step (c)(ii), the line segment of contact (17) has multiple locations relative to the centerline (e.g., locations on either side of the centerline).

In accordance with a fifth aspect, the invention provides apparatus (12) for use with a glass sheet (11) having a linear edge (23) which is to be finished, said apparatus comprising:

(a) a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) a belt drive system (e.g., a motor associated with one or more of rollers 27) for rotating the belt so that in the working zone (15), the outer surface of the belt (10) moves in a predetermined direction (19); and (c) a platen drive system (31, 33 or 35) for moving the platen (13) towards the linear edge (23) of the glass sheet, (11) so as to create a line segment of contact (17) between the outer surface of the belt (10) and the linear edge (23) that forms an included angle (e.g., angle $\epsilon$ in FIG. 2) with the predetermined direction (19) of less than 10 degrees.

In accordance with a sixth aspect, the invention provides apparatus for use with glass sheet (11) having a linear edge (23) which is to be finished, said apparatus comprising:

(a) a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) a belt drive system (e.g., a motor associated with one or more of rollers 27) for rotating the belt (10); and (c) a platen drive system (31, 33 or 35) for moving the platen (13) towards the linear edge (23) of the glass sheet (11) so as to create a line segment of contact (17) between the outer surface of the belt (10) and the linear edge (23);

wherein:

(i) the glass sheet (11) and the working zone (15) each define a plane (e.g., the Y-Z plane for the glass sheet and the x-z plane for the working zone for $\alpha$=0 in FIG. 7);

(ii) said planes intersect at a line which contains the line segment of contact (17); and (iii) the platen drive system (31, 33 or 35) provides at least two orientations for the plane of the working zone (15) relative to the plane of the glass sheet (11).

In accordance with a seventh aspect, the invention provides apparatus for use with a glass sheet (11) having a linear edge (23) which is to be finished, said apparatus comprising:

(a) a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) a belt drive system (e.g., a motor associated with one or more of rollers 27) for rotating the belt (10); and (c) a platen drive system (31, 35) for moving the platen (13) towards the linear edge (23) of the glass sheet (11) so as to create a line segment of contact (17) between the outer surface of the belt (10) and the linear edge (23);

wherein:

(i) the working zone (15) has a centerline (e.g., a centerline which falls on line 19 in FIG. 2); and (ii) the platen drive system (31, 35) causes the line segment of contact (17) to have multiple locations relative to the centerline (see, for example, FIG. 6).

In accordance with an eighth aspect, the invention provides apparatus for use with a glass sheet (11) having a linear edge (23) which is to be finished, said apparatus comprising:

(a) a belt assembly (10, 13, 27) which comprises:

(i) a belt (10) having an outer surface for removing glass from the linear edge (23) and an inner surface; and (ii) a platen (13) which contacts the belt's inner surface and defines a working zone (15) for the belt (10);

(b) a belt drive system (e.g., a motor associated with one or more of rollers 27) for rotating the belt (10); and (c) a platen drive system (31, 33 or 35) for moving the platen (13) towards the linear edge (23) of the glass sheet (11) so as to create a line segment of contact (17) between the outer surface of the belt and the linear edge (23);

wherein:

(i) the working zone (15) has a centerline (e.g., a centerline which falls on line 19 in FIG. 2); and (ii) the belt drive system causes the line segment of contact (17) to have multiple locations relative to the centerline (e.g., through oscillation of rollers 27).

In accordance with a ninth aspect, the invention provides apparatus for use with a glass sheet (11) having a linear edge (23) which is to be finished, said apparatus comprising:

(a) a belt assembly (10, 13, 27) which comprises:

(i) a belt (10) having an outer surface for removing glass from the linear edge (23) and an inner surface; and (ii) a platen (13) which contacts the belt's inner surface;

(b) a belt drive system (e.g., a motor associated with one or more of rollers 27) for rotating the belt (10); and (c) a platen drive system (31, 33 or 35) for moving the platen (13) towards the linear edge (23) of the glass sheet (11) to bring the outer surface of the belt into contact with the linear edge (23);

wherein:

(i) the glass sheet (11) lies in the Y-Z plane of an X,Y,Z coordinate system;

(ii) the linear edge (23) of the glass sheet has an orientation whereby it is either parallel to or at angle (e.g., angle $\alpha$ in FIG. 7) to the Z-axis of the X,Y,Z, coordinate system; and (iii) the platen drive system (31, 33 or 35) causes the platen (13) to adopt the orientation of the linear edge (23) as the outer surface of the belt (10) comes into contact with the linear edge (23).

Edge finishing in accordance with the invention has some, and, preferably all, of the following features:

(1) simultaneous grinding of the entire edge of the sheet at one time, i.e., one-step processing;

(2) the ability to compensate for errors in the loading of glass sheets into the grinding station;

(3) reduced stock removal compared to the existing grinding wheel approach;

(4) reduced production off glass particles which can bond to the surface of the glass sheet and result in rejected product;

(5) improved edge finishes, e.g., smoother edges; and/or (6) faster processing speeds.

Additional features and advantages of the invention are set forth in the detailed description which follows, and in part will be readily apparent to those skilled in the art from that description or recognized by practicing the invention as described herein.

The reference numbers used in the above summaries of the various aspects of the invention are only for the convenience of the reader and are not intended to and should not be interpreted as limiting the scope of the invention. More generally, it is to be understood that both the foregoing general description and the following detailed description, including the accompanying drawings which are incorporated in and constitute a part of this specification, are merely exemplary of the invention, and are intended to provide an overview or framework for understanding the nature and character of the invention.

BRIEF DESCRIPTION OF THE DRAWINGS

FIG. 10 comprises four photomicrographs which show in greater detail an edge contour produced by belt finishing of 0.7 mm 1737 glass. FIG. 10A shows the overall contour, while

In the above drawings, like reference numbers designate like or corresponding parts throughout the several views. The elements to which the reference numbers generally correspond are set forth in Table 1.

DESCRIPTION OF THE PREFERRED EMBODIMENTS

As discussed above, the present invention relates to a belt machining system for performing edge finishing in which the direction of rotation of the belt is along the axis of the glass' edge which is being finished. The belt can thus be thought of as running tangent to the glass.

Figure 2:
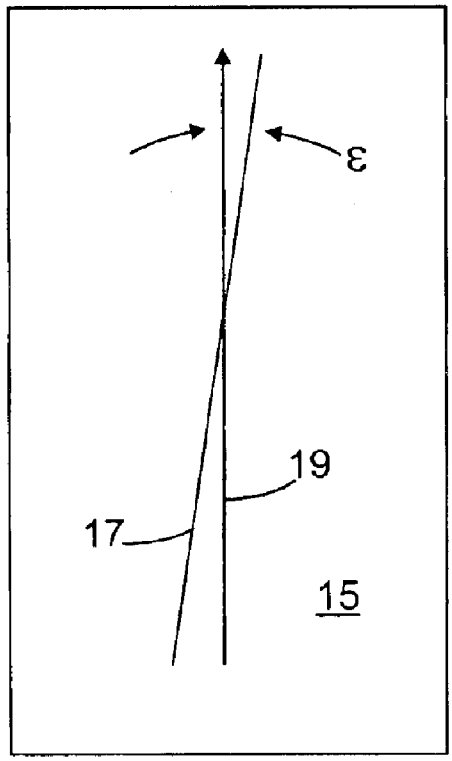
FIG. 2 is a schematic diagram illustrating the relationship between (1) the direction of belt movement and (2) edge orientation during edge finishing in accordance with the invention.

As a result of this orientation, contact of the glass' edge with the outer surface of the belt creates a line segment of contact at which the finishing occurs. This line segment can, for example, have a length on the order of 1,000 millimeters. The included angle $\epsilon$ (see FIG. 2) between the line segment of contact 17 and the belt's direction of motion 19 is less than 10°, preferably less than 5°, and most preferably essentially 0°.

The invention preferably employs a platen (belt backer plate) whose motion is pressure sensitive so that a "soft touch" can be achieved between the outer surface of the belt and the edge of the glass. The platen is designed to engage a portion of the backside (inner surface) of the grinding belt and is moved into and out of position using, for example, air actuated linkages or other pressure sensitive devices.

After engaging the backside of the belt, the platen pushes the outer surface of the belt against the edge of the glass. Significantly, because pressure sensitive positioning is employed, the platen's orientation automatically adjusts to match that of the axis of the glass' edge as the belt comes into contact with the edge. This is an important feature of the invention since it provides automatic accommodation for errors in the positioning of the glass sheet, e.g., errors introduced by the feed system which supplies glass sheets to the finishing system.

Figure 3:
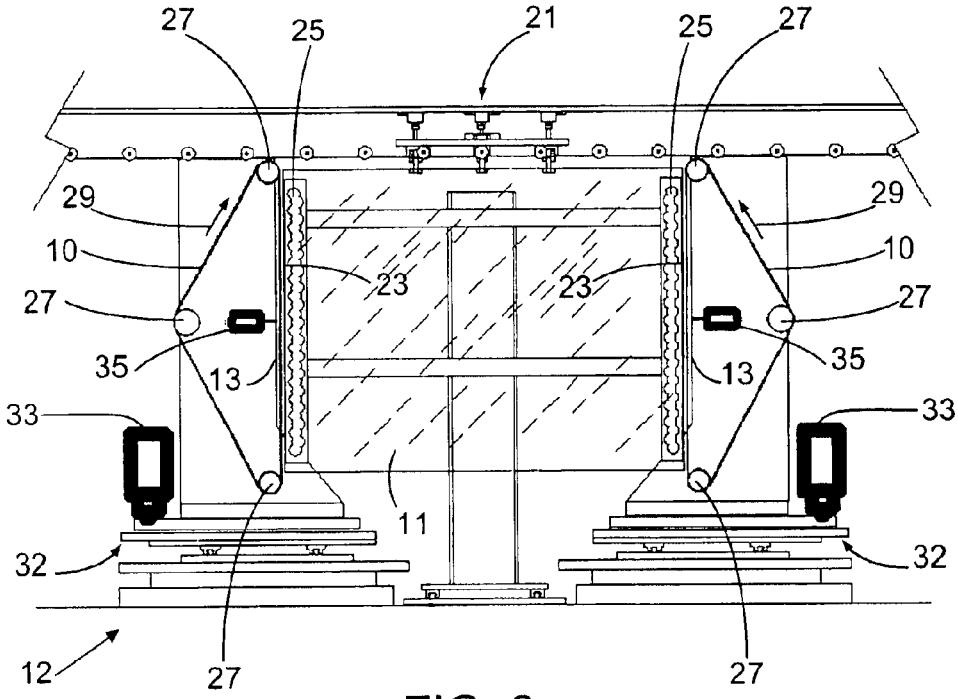
FIG. 3 is a schematic side view of a finishing station constructed in accordance with the invention.

FIG. 3 shows an overall arrangement for a finishing station 12 constructed in accordance with the invention. The figure illustrates the case where two opposing edges of glass sheet 11 are finished simultaneously, it being understood that finishing can be performed on one edge at a time, if desired. Similarly, all the edges of a sheet, e.g., all four edges, can be finished simultaneously, if desired. However, this may result in portions of some of the edges being unfinished which is generally undesirable, and thus finishing two complete edges at a time is preferred. In FIG. 3, the sheet is oriented vertically which is the preferred orientation for the finishing of LCD glass since such glass is typically manufactured, scored, inspected, coated, and packaged in this orientation. It is to be understood, of course, that finishing in accordance with the invention can also be conducted with the sheet oriented at an angle to vertical, e.g., with the sheet oriented horizontally. The following discussion is in terms of the system of FIG. 3, it being understood that the invention is equally applicable to the foregoing variations, among others.

As shown in FIG. 3, sheet 11 is brought into position by conveyor system 21 and is then held in place near its edges by vacuum system 25. The vacuum system applies sufficient force to sheet 11 to prevent movement of the sheet as the finishing takes place. Preferably, the vacuum force is applied at a position close to the glass' edge where it can help stabilize the edge and thus minimize its vibration during finishing. For example, the spacing between the edge of the glass and the position where the vacuum force is applied can be approximately 0.25 inches (~6 millimeters). The entrance port of the vacuum system is preferably configured to provide local support to the glass in the region where the vacuum force is applied. For example, an entrance port having a serpentine pattern along its length has been found suitable for this purpose. If desired, the vacuum system can be gimbeled to provide additional accommodation for errors in the positioning of the glass sheet.

Each belt 10 is mounted on a set of pulleys or rollers 27 (three being illustrated in FIG. 3 for each belt) and is driven, e.g., by a motor connected to one of the rollers, so that the belt moves downward past the glass' edge (see arrows 29). Alternatively, one or both belts can move upward.

In certain embodiments, in addition to rotating about their axes, rollers 27 are also oscillated in a direction transverse to the plane of the glass sheet. Such transverse oscillation can be achieved by oscillating the rollers' axes or their support structure. Oscillation of this type moves the line segment of contact 17 (see FIG. 2) to different locations on the face of the belt. In this way, a large fraction of the belt's width can be used for finishing, which increases belt life. For example, to finish LCD glass having a thickness of 0.7 millimeters using a belt having a width of 150 millimeters, it is desirable to employ on the order of 100 millimeters of the width in order to achieve a belt life which is cost competitive with the grinding wheel technique currently in use.

In practice, it has been found that a substantial amount of the belt's wear occurs during the initial contact of the glass' edge with the belt. The transverse oscillation of rollers 27 and thus of belt 10 moves the line of initial contact to different places across the width of the belt and thus minimizes the effects of this high rate of wear. To help ensure a spread in the location of the initial contact across the width of the belt, the transverse oscillation can be randomized, if desired.

As discussed above, platen 13 contacts the backside of belt 10 and pushes it into contact with the glass' edge which is to be finished. This contact of the platen with the belt generates the belt's working zone 15 (see FIG. 2), whose configuration and dimensions generally correspond to the configuration and dimensions of the face of the platen.

Figure 4:
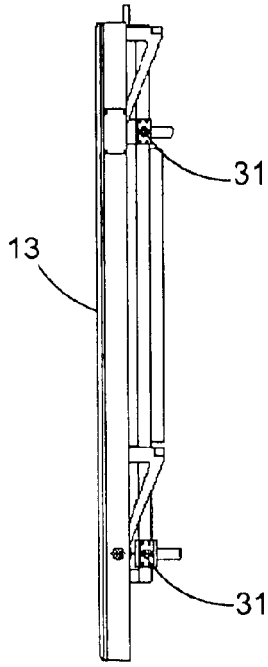
FIG. 4 is a schematic side view of a pressure sensitive platen for use in the edge finishing station of FIG. 3.

FIG. 4 is a more detailed side view of platen 13 showing air cylinders 31, which allow the face of the platen to adjust to any lack of verticality of the edge of the glass. Such lack of verticality typically results from errors in the positioning of the glass sheet by conveyor system 21. Air cylinders 31 allow platen 13 to be oriented at the same angle to vertical as the edge of the glass sheet (e.g., angle a in FIG. 7; see below).

The air cylinders also allow for selection (adjustment) of the force between the outer surface of the belt and the glass edge. This force in combination with the belt's speed and surface characteristics determine the rate at which material is removed from the edge. These parameters also determine the surface roughness of the finished edge. Preferably, the air cylinders have low internal friction so that the force applied to the glass' edge can be accurately controlled. Preferably, two air cylinders, which most preferably have independent pressure, controls, are used, with one at the top and the other at the bottom of the platen as shown in FIG. 4. A single air cylinder located at the middle of the platen can also be used but provides less control over the movement of the platen. More than two air cylinders can also be used but in general are not necessary.

Belts having a variety of constructions and surface characteristics can be used in the practice of the invention, including belts having patterned surfaces (i.e., engineered belts) and those having random surfaces. Belts having random surfaces are currently preferred because there is less tendency for the belt to groove upon initial contact with the sharp corners of the glass' edge. Such grooving has been found to result in the belt undergoing a stick and jump motion, which results in poor finishing of the edge. Based on the disclosure herein, persons skilled in the art can readily select a suitable belt construction for any particular application of the invention, as well as a suitable belt speed and applied force between the belt and the edge of the glass sheet. Examples of suitable belt speeds include speeds between about 1700 and about 2500 feet/minute; examples of suitable applied forces include forces between about 4 and about 10 pounds for an edge length of 1 meter.

Figure 1:
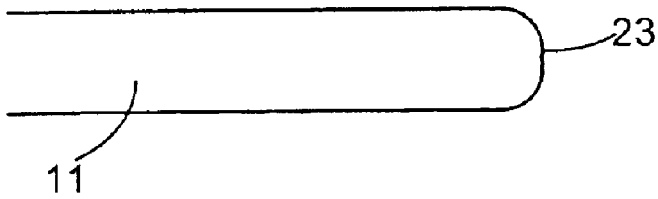
FIG. 1 is a schematic diagram illustrating the type of edge profile a glass sheet preferably has after finishing.

Returning to FIG. 3, this figure shows two approaches for providing a profile of the type shown in FIG. 1 to the edge of the glass. In one approach, schematically illustrated by drive systems 33, rollers 27 and platen 13 are moved together relative to the edge while the finishing takes place to provide the edge with the desired profile. Drive systems 33 can, for example, be used to translate and rotate platforms 32 upon which belts 10, rollers 27, and platens 13 are mounted. In the other approach, schematically illustrated by drive systems 35, just the platen is moved with the rollers remaining stationary. In either case, the rollers can oscillate transversely, as discussed above. Also, in both approaches, a pressure sensitive platen is preferably used to accommodate errors in the positioning of the glass sheet.

Figure 5:
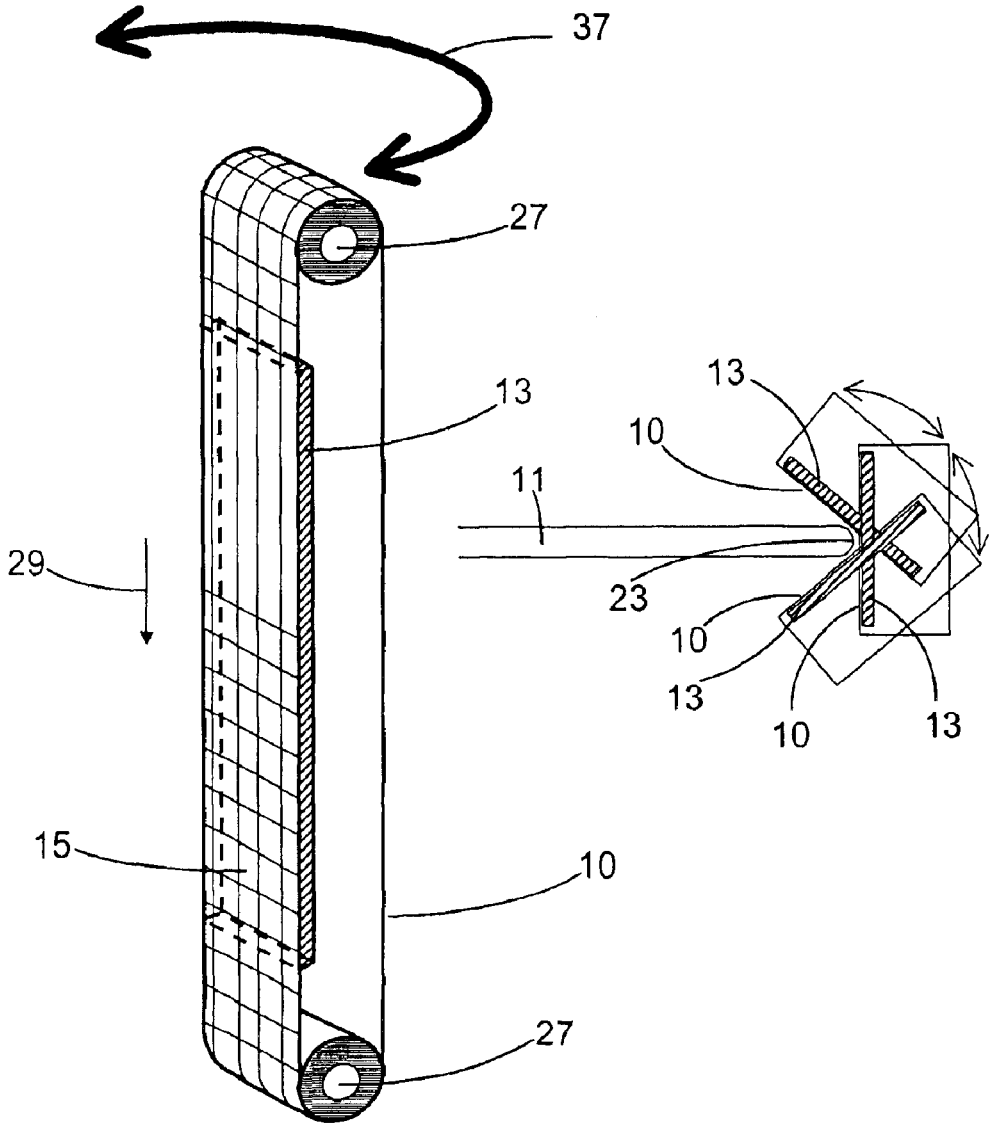
FIG. 5 is a schematic diagram illustrating an embodiment of the invention in which a platen and its rollers translate and rotate during edge finishing.

The first approach is further illustrated in FIG. 5 where arrow 37 illustrates the combined movement of rollers 27 and platen 13. As shown in the right hand portion of this figure, this movement preferably results in removal of material from the leading portion and both corner portions of the glass' edge 23.

Figure 6:
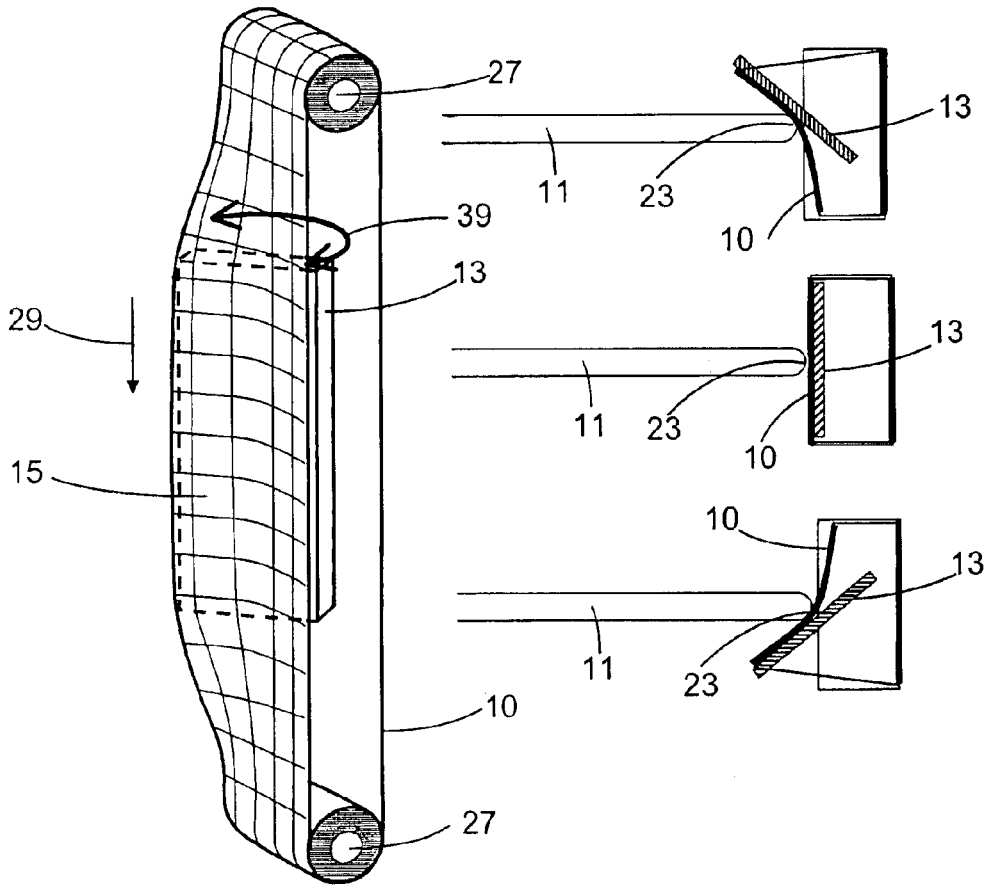
FIG. 6 is a schematic diagram illustrating an embodiment of the invention in which just a platen translates and rotates during edge finishing.

The second approach is further illustrated in FIG. 6 where arrow 39 illustrates movement of platen 13, with rollers 27 remaining stationary (other than for any optional transverse oscillation). Again, the right hand portion of this figure shows that the effect of this movement is to remove material from the corner portions and the leading portion of edge 23.

However, in this case, as also shown in FIG. 6, the relative motion between the platen and the rollers imparts a twist to belt 10. In practice, this twisting in combination with the force applied to the belt by the platen on one side and the glass' edge on the other, causes the belt to wander sidewise. Such wandering automatically uses different portions of the belt width to perform the finishing, thus increasing belt life. This use of different parts of the belt width as a result of wandering can be combined with transverse oscillation of rollers 27 if desired. Alternatively, for some applications, the wandering effect may by itself provide sufficient belt life.

As can be seen in the right hand portions of both FIGS. 5 and 6, the finishing of edge 23 involves movement of the belt's working zone into multiple orientations with respect to the plane of the glass sheet. The geometry involved is illustrated in FIG. 7, where two Cartesian coordinate systems are shown, i.e., an X,Y,Z system associated with the glass sheet and an x,y,z system associated with platen 13 (and thus with the belt's working zone 15) The Z-axis of the X,Y,Z-coordinate system is assumed to be parallel to the z-axis of he x,y,z-coordinate and both axes are taken as vertical, it being understood, as discussed above, that the vertical orientation is for purposes of illustration only.

In this figure, the surface of the glass sheet is treated as being in the Y-Z plane of the X,Y,Z-coordinate system and the face of the platen is treated as being in the x-z plane of the x,y,z-coordinate system. In the X,Y,Z-coordinate system, the edge to be finished is oriented at an angle $\alpha$ with respect to the Z-axis, i.e., it is assumed that the edge is not perfectly vertical. As discussed above, this orientation of the edge is accommodated by air cylinders 31. Thus, in the x,y,z-coordinate system, the face of the platen makes the same angle $\alpha$ with respect to the z-axis as the edge of the glass makes with the Z-axis.

In the most general case, complete freedom of movement can be provided for the x,y,z-coordinate system and its associated platen relative to the X,Y,Z-coordinate system and its associated glass sheet. Such movement can be provided using, for example, an industrial robot or a dedicated 3-dimensional translation system, e.g., a translation system employing linear rails and suitable motors capable of providing precision positioning of the platen.

Figure 7:
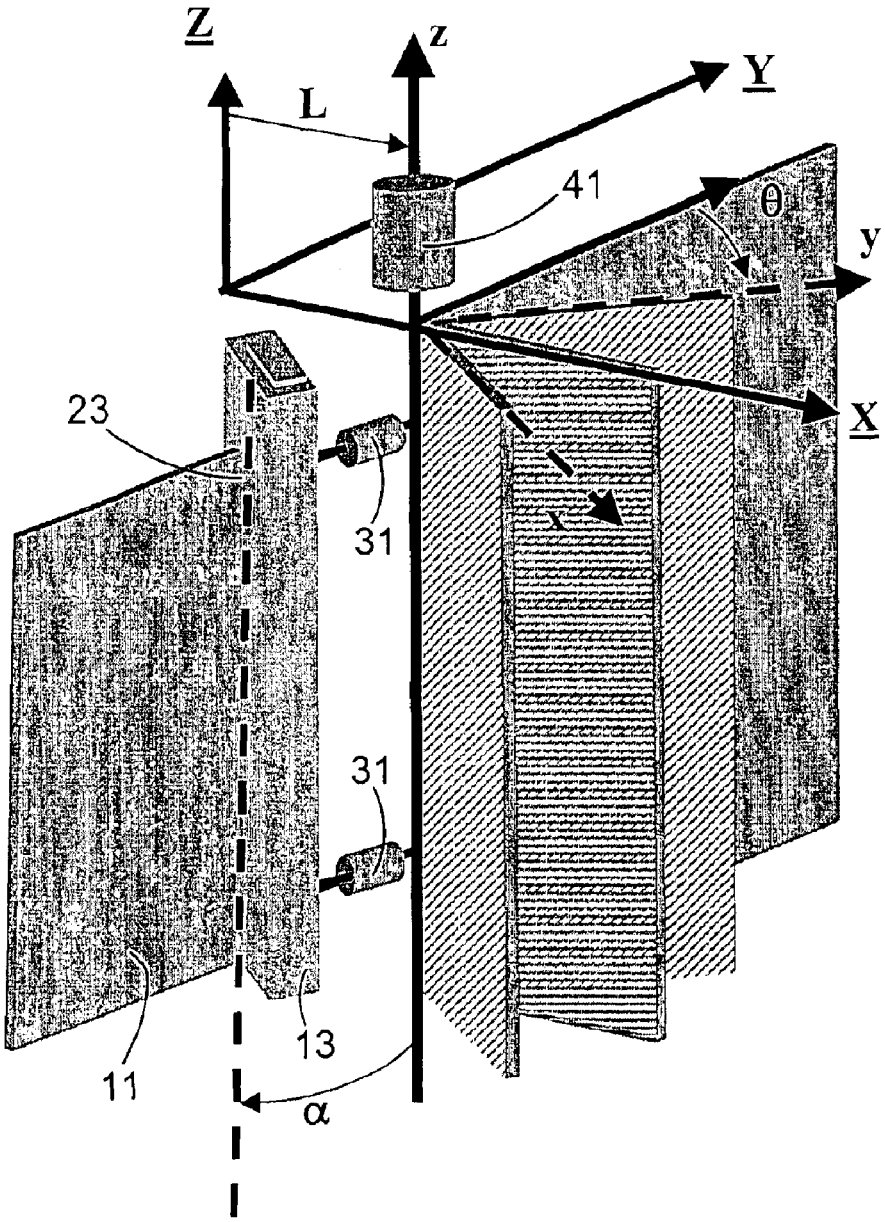
FIG. 7 is a schematic diagram illustrating an X,Y,Z-coordinate system associated with a glass sheet which is to be edge finished and an x,y,z-coordinate system associated with a platen used in such finishing.

However, as illustrated in FIG. 7, it has been found in practice that excellent edge finishing can be achieved through a combination of translation of the origin of the x,y,z-coordinate system in a direction orthogonal to the surface of the glass sheet (i.e., in the direction of the X-axis) and rotation of the x and y coordinates of the x,y,z-coordinate system relative to the X and Y coordinates of the X,Y,Z-coordinate system. In FIG. 7, the translation is shown schematically by the variable "L" and the rotation by the variable "θ". The translation and rotation can be performed using conventional computer-controlled motors and linkages, one such motor for performing rotation being shown schematically in FIG. 7 by reference number 41.

Figure 8:
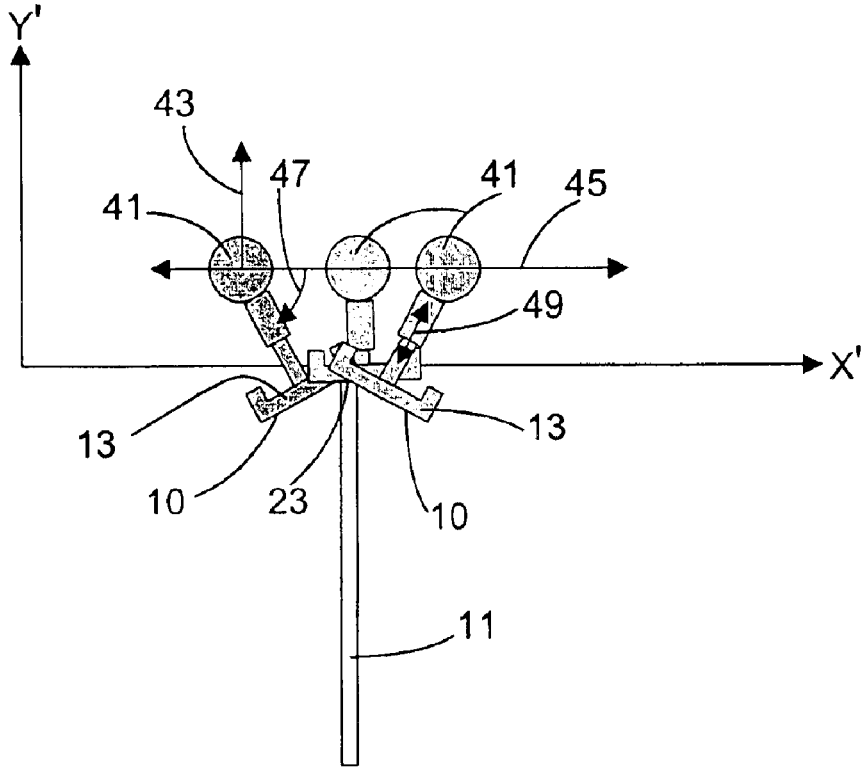
FIG. 8 is a schematic drawing illustrating the motions of the platen of FIG. 7 as seen from above.

FIG. 8 summarizes the various motions of such a translation plus rotation finishing system as seen from above. In this figure, 45 represents linear motion, 47 represents rotary motion, 49 represents motion of the platen produced by the air cylinders, X'-Y' are machine-based coordinates, and 43 is optional overall motion relative to the X'-Y' coordinates to bring the finishing system into position. By selecting values for these motions essentially any desired profile can be applied to edge 23.

Finishing of the glass' edge generates heat and thus a cooling liquid, typically, water, is preferably applied to the belt and the glass surface in the vicinity of the line segment of contact between the glass' edge and the outer surface of the belt. Such cooling primarily serves to prevent premature belt failure as a result of deterioration of the bond between the belt's surface abrasive and the body of the belt. The cooling liquid can be applied along the entire length of the glass' edge or only at the top of the glass sheet with gravity producing a downward flow along the remainder of the edge. For example, one inch wide nozzles with holes along their face, one on each side of the glass sheet, located at the top of the glass sheet and aimed downward and inward so that they wet about two inches of the belt's width throughout the motion of the platen have been found to work successfully. To avoid unnecessary contamination, it is generally preferred to minimize the amount of cooling liquid which contacts the major surfaces of the glass sheet.

Platen 13 will typically (and preferably) be constructed of a rigid (non-compliant) material so as to provide a firm backing for belt 10, e.g., the platen can be composed of a metal having a low friction coating, such as a TEFLON coating, to minimize friction between the platen and the backside of the belt. Alternatively, but less preferred, the face of platen 13 can be formed of a resilient (compliant) material with the edge of the glass deforming the outer surface of the belt and the underlying resilient material along the line segment of contact between the edge and the belt's outer surface. In this way, the profile of FIG. 1 can be generated by the concave deformation of the belt along the line segment of contact without the need for translating or rotating the platen relative to the glass' edge. The resilient material can also compensate for misalignments of the glass' edge from vertical. However, the use of air cylinders 31 for this purpose even with a resilient platen is generally preferred.

The coefficient of friction of the outer surface of the resilient material needs to be sufficiently low so that excessive heat is not generated at the interface between that surface and the backside of the belt. Alternatively, the resilient material can be in the form of a second belt located inboard of the primary belt which contacts the backside of the primary belt along a portion of its path of motion to form the working zone. Heat generation at the interface of the resilient material with the backside of the primary belt can then be avoided by adjusting the surface speed of the second belt to be the same as the surface speed of the primary belt so that there is reduced relative motion between the belts at their points of contact, e.g., no relative motion.

When a platen having a resilient surface is used, the edge being finished need not be stationary relative to the surface of the primary belt, but can move along the line of contact between the edge and the belt. Such relative movement can also occur for a rigid platen, but is generally not preferred since it limits the time available for rotating and translating the platen relative to the glass' edge to achieve the desired edge profile.

Without intending to limit it in any manner, the present invention will be more fully described by the following examples.

EXAMPLE 1

Belt finishing was performed on two inch wide strips of 0.7 mm 1737 glass one meter long using a rotating and translating platen equipped with air cylinders at its top and bottom (see FIG. 4). One scored and broken edge of each strip was finished. The edge overhung the vacuum chuck, used to hold the strip by approximately 6 mm.

The belt used in the finishing was 152 mm wide (6 inches) and due to the twisting of the belt (see FIG. 6), approximately 70 mm of the belt surface contacted the edge during the finishing operation. In some experiments, the rollers for the belt were oscillated over a distance of approximately 25 mm, which increased to 95 mm the width of the belt used during finishing. Various commercially available belts were tested, with a 320 NORTON $Al_2O_3$ belt found well suited for edge finishing in accordance with the invention (Norton Abrasives, Worcester, Mass.). Water was applied to the interface between the edge and the belt during the finishing.

Motion of the platen with respect to the glass' edge was computer controlled, with the following parameters being adjustable: $\theta$, $d\theta/dt$, L, dL/dt, and dwell time at each position (see FIG. 7). These parameters, along with belt type, belt speed, and platen force, were empirically adjusted to produce the desired edge profile for an overall process cycle that comprised the following steps:

(1) The platen was moved to a starting "L" position.

(2) The platen was rotated to a starting "$\theta$" position.

(3) The air cylinders extended the platen against adjustable hard stops, which kept the platen from touching the glass at this point.

(4) The "L" position was changed to move the platen into contact with the glass edge. As this movement occurred, the platen was pushed back as a result of contact with the glass, with the air cylinders maintaining a constant force between the belt's outer surface and the glass.

(5) The platen was then rotated and translated from one side of the glass to the other while the air cylinders kept the belt in contact with the glass to form a contoured edge. Stock removal was controlled to be between 50 and 125 microns, the lower limit having been found sufficient for flaw removal.

(6) After the edge finishing was completed, the air cylinders retracted the platen, and the platen was moved back to its home position in preparation for the next cycle.

Typically, the foregoing steps took approximately 10 to 25 seconds to complete.

The platen was able to compensate for 1–2 mm top to bottom off axis positioning of the glass. For example, if the glass was mounted such that the bottom was 1–2 mm closer to the platen than the top, the platen would still contact the glass evenly from top to bottom and apply even pressure along the entire edge.

Figure 9:
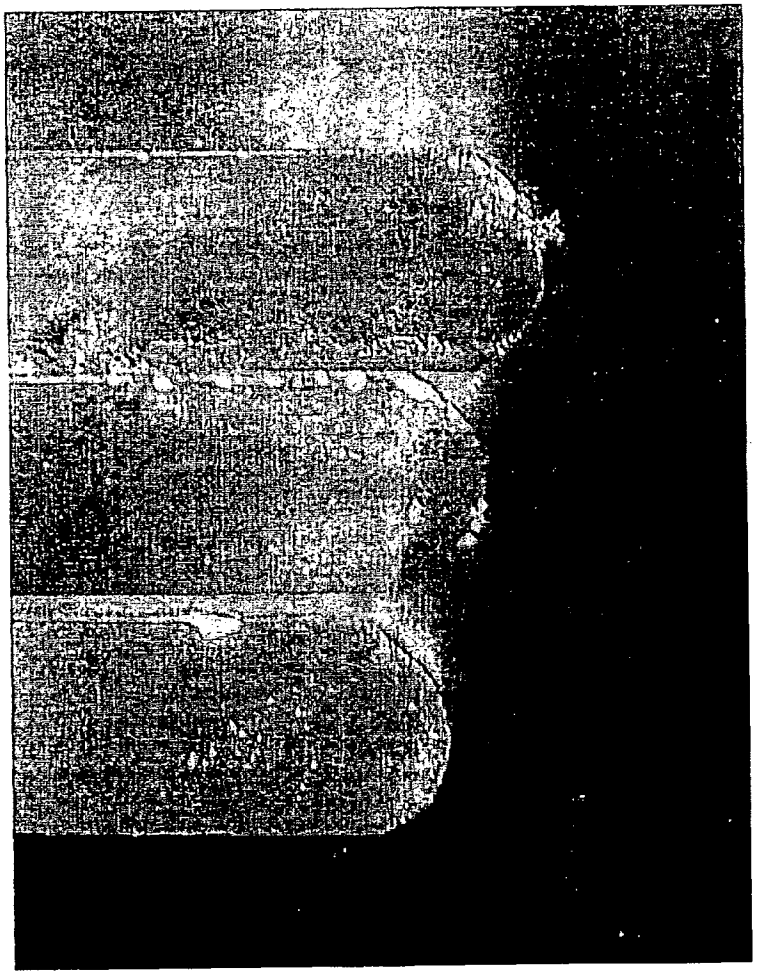
FIG. 9 is a photomicrograph showing edge configurations (contours) achieved by belt finishing of a 1,000 millimeter edge of an LCD substrate glass having a thickness of 0.7 mm and sold by Corning Incorporated (Corning, N.Y.) under the glass number 1737 (hereinafter "0.7 mm 1737 glass"). The left, middle, and right profiles are near the top, middle, and bottom of the 1,000 millimeter edge, respectively.
Figure 10A:
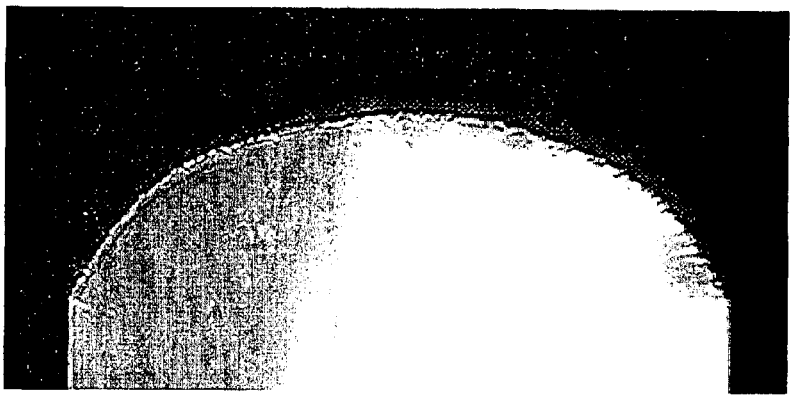
Figure 10B:
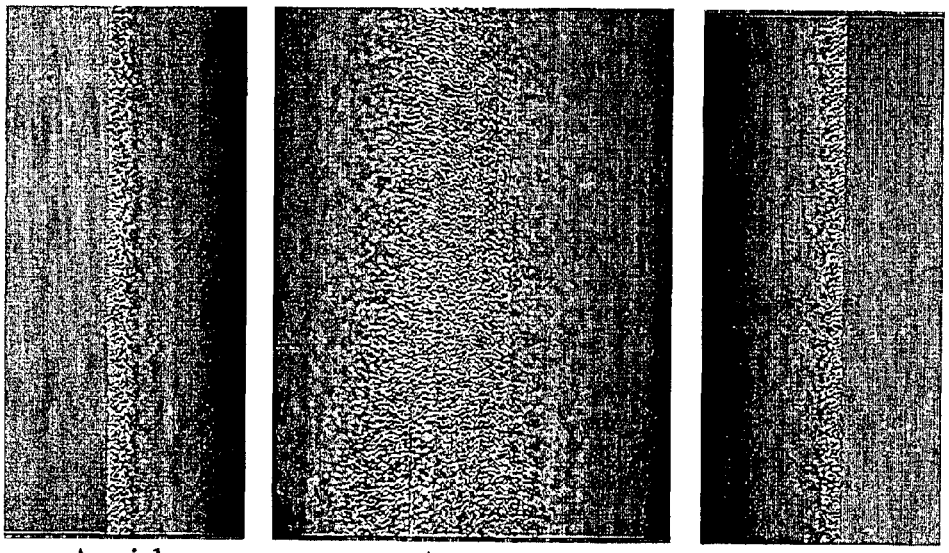
FIG. 10B shows the A side (side on which, for example, thin film transistors are formed), the apex, and the B side at 200× magnification.

FIG. 9 is a photomicrograph showing typical edge contours achieved by the above procedure, where the left, middle, and right profiles of this figure are located near the top, middle, and bottom of the 1,000 millimeter edge, respectively. FIG. 10 shows the edge contour in greater detail, with FIG. 10A showing the overall contour and FIG. 10B showing the A side, apex, and B side at 200× magnification.

Figure 11:
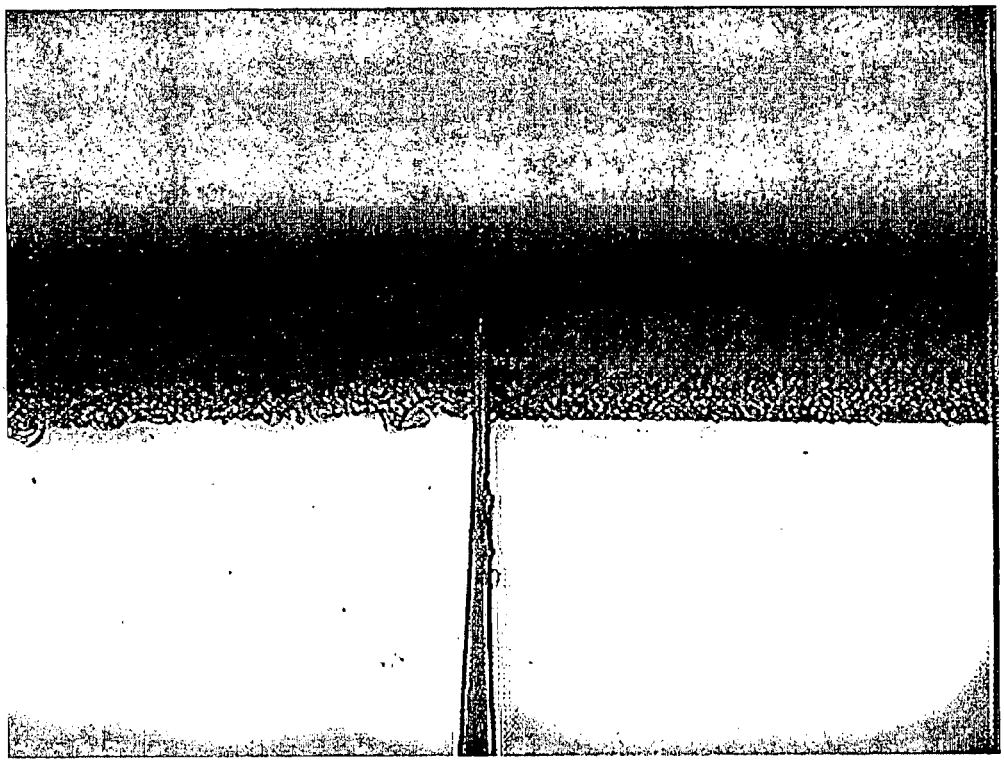
FIG. 11 comprises two photomicrographs which compare the edge finish of 0.7 mm 1737 glass obtained by wheel grinding (left image) with that obtained by belt finishing (right image).

FIG. 11 compares an edge profile produced by the conventional metal-bonded diamond grinding wheel approach (left image) with one produced using belt finishing in accordance with the above procedure. The belt finished edge is visually smoother in this figure.

Figure 12:
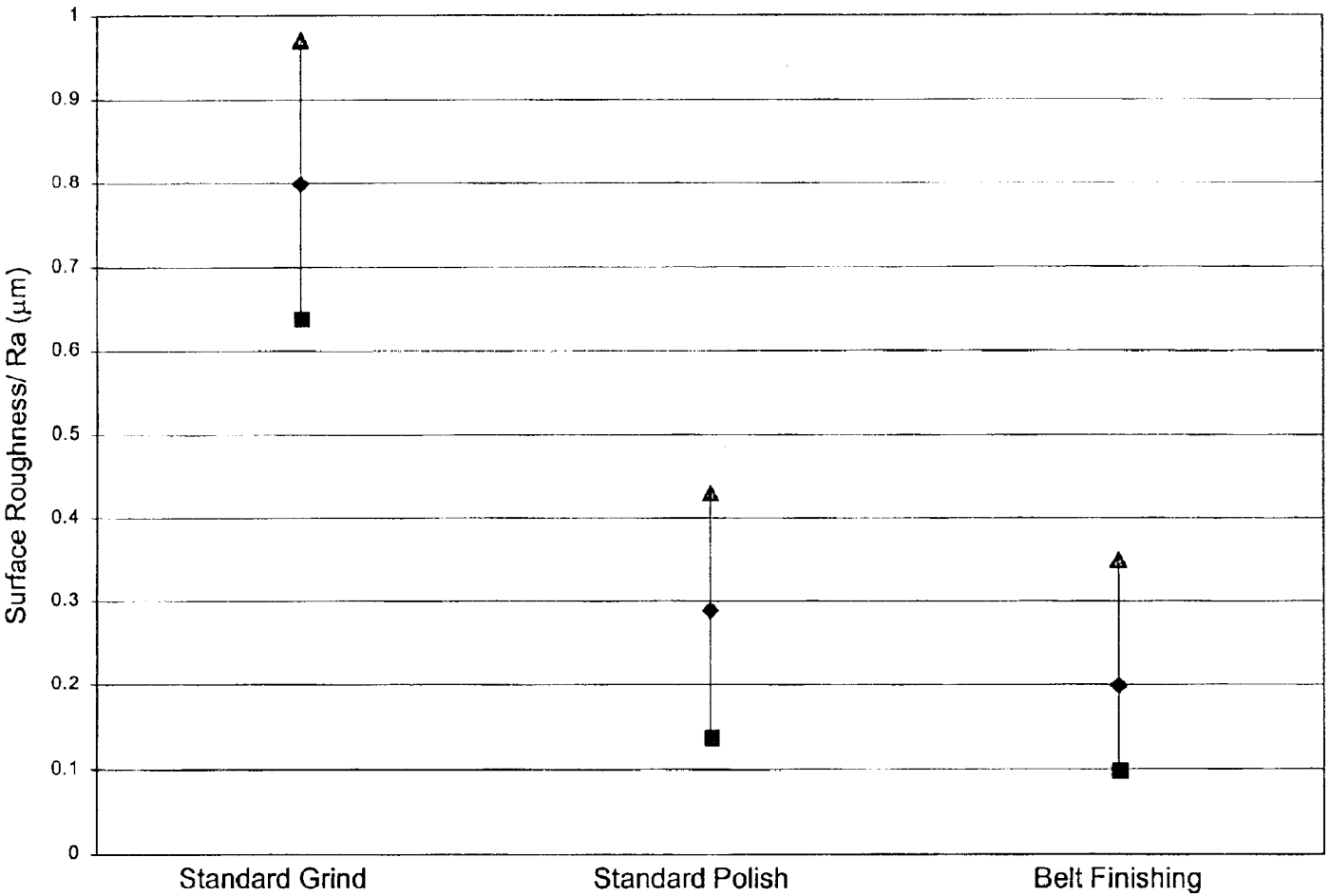
FIG. 12 compares belt finishing of 0.7 mm 1737 glass with (1) grinding with a conventional metal-bonded grinding wheel (standard grind) and (2) wheel grinding followed by polishing (standard polish). In this figure, triangles, diamonds, and squares represent the maximum, average, and minimum measured surface roughness for the three test conditions, respectively.

FIG. 12 quantitatively compares edge finishing using a 320 NORTON $Al_2O_3$ belt with conventional wheel grinding and with wheel grinding plus polishing. As can be seen in this figure, belt finishing produces surface roughness values substantially below those produced by wheel grinding. Indeed, the surface roughness values obtained in this experiment were better than those achieved when wheel grinding was combined with the extra step of polishing.

Figure 13:
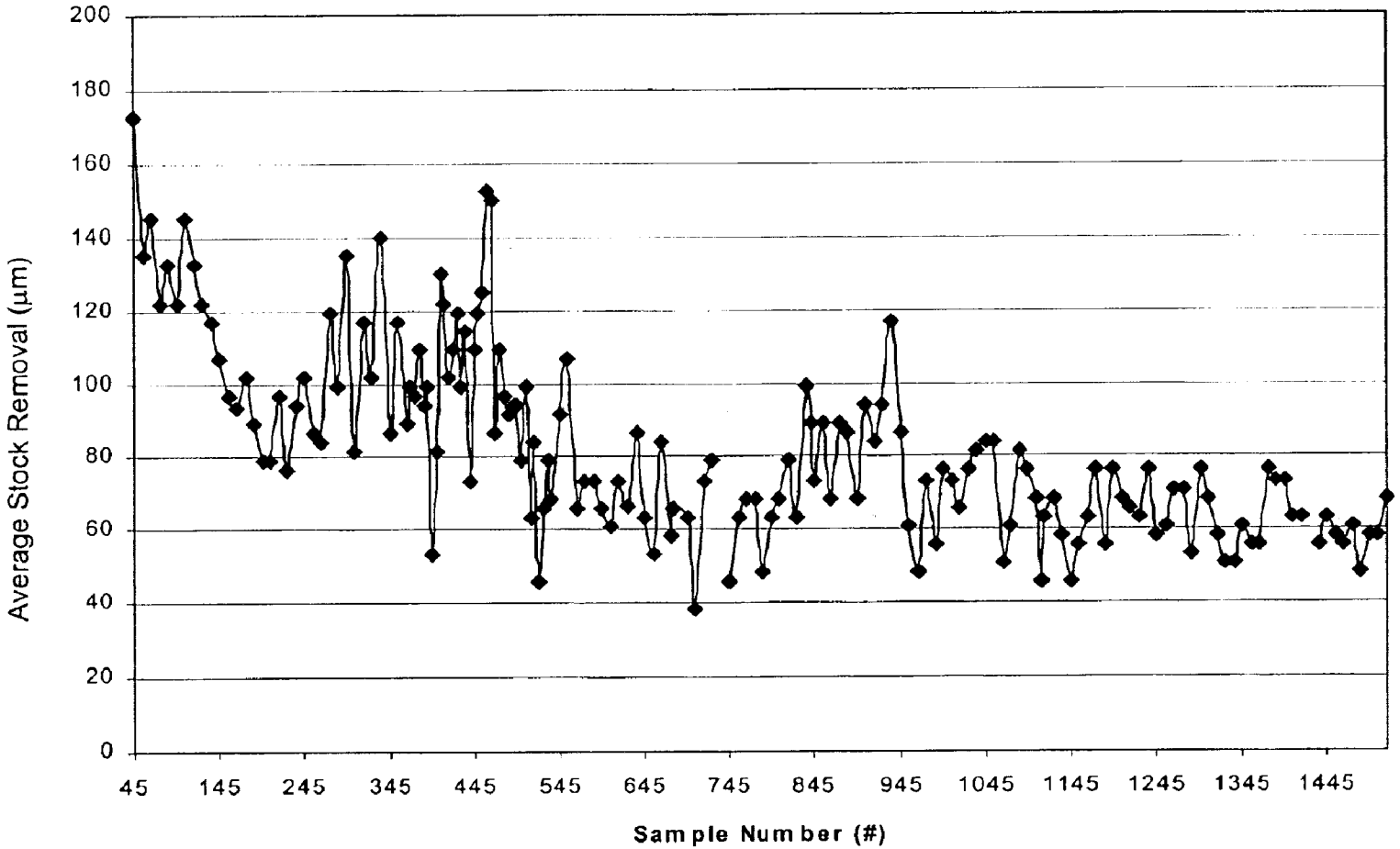
FIG. 13 shows the results of a test of stock removal in microns versus number of edges finished for belt finishing of 0.7 mm 1737 glass using a commercially available $Al_2O_3$ belt.

Further experiments showed that surface roughness (Ra value) had an average value of less than 0.3 microns throughout a series of 1475 samples finished with a single 320 NORTON $Al_2O_3$ belt (i.e.; approximately 1500 meters of glass), with the values for the tops, middles, and bottoms of the edges being less than 0.35 microns throughout the series. FIG. 13 shows that stock removal remained fairly constant for this length of glass and well below the 200 micron levels used with wheel grinding. The data of this figure is again for a single 320 NORTON $Al_2O_3$ belt.

EXAMPLE 2

An LCD substrate edge was contour ground using a mineral-coated belt supported on a pressure fed resilient platen.

The belt was a Micro-Mesh MX150—Cloth Backed Belt (40 micron grit) (Micro-Surface Finishing Products, n.c., Wilton, Iowa) and the platen was in the form of a rotatable soft silicone hub upon which the belt was mounted. The hub had a diameter of about 6 inches. The glass traverse speed was 4 meters/minute, the contact pressure was 4 newtons, and the belt speed was 1570 feet per minute. The belt was 4 inches wide and 36 inches long. In addition to the soft silicone hub, the belt was also supported by a driven wheel. The original scored and broken edge of 0.7 mm 1737 glass was used in the experiment, with water being applied to the line of contact between the edge and the belt during the finishing procedure.

The soft silicone was found to be effective in allowing the belt to conform to the glass edge. This resulted in an 80 micron bevel width with a good edge radius. Ra was about 0.3 microns and the maximum interface chip size was about 50 microns. This interface quality was equal to or better than that achieved with wheel grinding. Belt wear was minimal with the belt being hardly marked after forming three edges, each 460 mm long.

Although specific embodiments of the invention have been described and illustrated, it is to be understood that modifications can be made without departing from the invention's spirit and scope. For example, although it is preferred to belt finish an entire edge in one operation, e.g., it is preferred that the line segment of contact between the edge and the outer surface of the belt is equal to the total length of the edge, smaller portions of an edge can be finished at one time with the remainder of the edge being finished in subsequent operations or left unfinished. Similarly, since the motion of the platen is programmable, a variety of edge shapes besides a full contour can be applied to the edge of the glass, e.g., a C-chamfer can be applied.

A variety of other modifications which do not depart from the scope and spirit of the invention will be evident to persons of ordinary skill in the art from the disclosure herein. The following claims are intended to cover the specific embodiments set forth herein as well as such modifications, variations, and equivalents.

TABLE 1

| Number | Element |
|---|---|
| 10 | belt |
| 11 | glass sheet |
| 12 | finishing station |
| 13 | platen |
| 15 | working zone of belt |
| 17 | line segment of contact between the glass' edge and the outer surface of belt |
| 19 | direction of motion of belt |
| 21 | conveyor system |
| 23 | edge of glass sheet |
| 25 | vacuum system for holding glass sheet |
| 27 | rollers for belt |
| 29 | arrow illustrating belt movement |
| 31 | air cylinders for moving platen |
| 32 | platform |
| 33 | drive system for embodiments where both platen and belt rollers move |
| 35 | drive system for embodiments where platen moves |
| 37 | arrow illustrating movement of platen and belt rollers |
| 39 | arrow illustrating movement of platen |
| 41 | motor |
| 43 | linear motion |
| 45 | linear motion |
| 47 | rotary motion |
| 49 | platen motion |

What is claimed is:

1. A method for finishing a linear edge of a glass sheet comprising:

(a) providing a belt assembly which comprises:

(i) a belt having an outer surface for removing glass from the linear edge and an inner surface; and (ii) a platen which contacts the belt's inner surface and defines a working zone for the belt;

(b) rotating the belt so that in the working zone, the outer surface of the belt moves in a predetermined direction; and (c) finishing said linear edge of the glass sheet by:

(i) bringing the outer surface of the belt and the linear edge into contact to form a line segment of contact between the surface and the linear edge, said line segment of contact being in the working zone; and (ii) removing glass from the linear edge by maintaining the linear edge in contact with the surface;

wherein the line segment of contact and the predetermined direction have an included angle of less than 10 degrees.

2. The method of claim 1 where the included angle is less than 5 degrees.

3. The method of claim 1 wherein the included angle is essentially zero degrees.

4. The method of claim 1 wherein during at least a part of step (c), the length of the line segment of contact is at least 90% of the total length of the linear edge.

5. The method of claim 1 wherein the linear edge is stationary during step (c).

6. The method of claim 1 wherein the linear edge is vertically oriented during step (c).

7. The method of claim 1 wherein during step (c) a cooling liquid is applied to the glass sheet and/or the outer surface of the belt in the region of the line segment of contact.

8. The method of claim 1 wherein the platen is resilient.

9. The method of claim 1 wherein:

(i) the glass sheet and the working zone each define a plane;

(ii) said planes intersect at a line which contains the line segment of contact; and (iii) the plane of the working zone has at least orientations with respect to the plane of the glass sheet during step (c)(ii).

10. The method of claim 1 wherein:

(i) the working zone has a centerline; and (ii) during step (c)(ii), the line segment of contact has multiple locations relative to the centerline.

11. The method of claim 10 wherein said multiple locations comprise locations on either side of the centerline.

12. The method of claim 1 wherein step (c)(i) comprises moving the platen towards the linear edge of the glass sheet.

13. The method of claim 12 wherein:

(i) the glass sheet lies in the Y-Z plane of an X,Y,Z coordinate system;

(ii) prior to being contacted by the outer surface of the belt in step (c)(i), the linear edge has an orientation whereby it is either parallel to or at angle to the Z-axis of the X,Y,Z coordinate system; and (iii) the platen adopts said orientation of the linear edge as the outer surface of the belt comes into contact with the linear edge during step (c)(i).

14. The method of claim 12 wherein the amount of force with which the outer surface of the belt contacts the linear edge is adjustable.

15. A method for finishing a linear edge of a glass sheet comprising:

(a) providing a belt assembly which comprises:

(i) a belt having an outer surface for removing glass from the linear edge and an inner surface; and (ii) a platen which contacts the belt's inner surface and defines a working zone for the belt;

(b) rotating the belt; and (c) finishing said linear edge of the glass sheet by:

(i) bringing the outer surface of the belt and the linear edge into contact to form a line segment of contact between the surface and the linear edge, said line segment of contact being in the working zone; and (ii) removing glass from the linear edge by maintaining the linear edge in contact with the surface;

wherein:

(i) the glass sheet and the working zone each define a plane;

(ii) said planes intersect at a line which contains the line segment of contact; and (iii) the plane of the working zone has at least two orientations with respect to the plane of the glass sheet during step (c)(ii).

16. A method for finishing a linear edge of a glass sheet comprising:

(a) providing a belt assembly which comprises:

(i) a rotating belt having an outer surface for removing glass from the linear edge and an inner surface; and (ii) a platen which contacts the belt's inner surface; and (b) finishing said linear edge of the glass sheet by:

(i) bringing the outer surface of the belt and the linear edge into contact by moving the platen towards the linear edge; and (ii) removing glass from the linear edge by maintaining the linear edge in contact with the surface;

wherein:

(i) the glass sheet lies in the Y-Z plane of an X,Y,Z coordinate system;

(ii) prior to being contacted by the outer surface of the belt in step (b)(i), the linear edge has an orientation whereby it is either parallel to or at angle to the Z-axis of the X,Y,Z coordinate system; and (iii) the platen adopts said orientation of the linear edge as the outer surface of the belt comes into contact with the linear edge during step (b)(i).

17. The method of claim 16 wherein the amount of force with which the outer surface of the belt contacts the linear edge is adjustable.

18. A method for finishing a linear edge of a glass sheet comprising:

(a) providing a belt assembly which comprises:

(i) a belt having an outer surface for removing glass from the linear edge and an inner surface; and (ii) a platen which contacts the belt's inner surface and defines a working zone for the belt;

(b) rotating the belt; and (c) finishing said linear edge of the glass sheet by:

(i) bringing the outer surface of the belt and the linear edge into contact to form a line segment of contact between the surface and the linear edge, said line segment of contact being in the working zone; and (ii) removing glass from the linear edge by maintaining the linear edge in contact with the surface;

wherein:

(i) the working zone has a centerline; and (ii) during step (c)(ii), the line segment of contact has multiple locations relative to the centerline.

19. The method of claim 18 wherein said multiple locations comprise locations on either side of the centerline.

20. Apparatus for use with a glass sheet having a linear edge which is to be finished, said apparatus comprising:

(a) a belt assembly which comprises:

(i) a belt having an outer surface for removing glass from the linear edge and an inner surface; and (ii) a platen which contacts the belt's inner surface and defines a working zone for the belt;

(b) a belt drive system for rotating the belt so that in the working zone, the outer surface of the belt moves in a predetermined direction; and (c) a platen drive system for moving the platen towards the linear edge of the glass sheet so as to create a line segment of contact between the outer surface of the belt and the linear edge that forms an included angle with the predetermined direction of less than 10 degrees.

21. The apparatus of claim 20 wherein the platen is resilient.

22. The apparatus of claim 20 wherein:

(i) the glass sheet and the working zone each define a plane;

(ii) said planes intersect at a line which contains the line segment of contact; and (iii) the platen drive system provides at least two orientations for the plane of the working zone relative to the plane of the glass sheet.

23. The apparatus of claim 22 wherein the belt drive system comprises rollers and the platen drive system moves both the rollers and the platen.

24. The apparatus of claim 22 wherein the belt drive system comprises rollers and the platen drive system moves the platen but not the rollers.

25. The apparatus of claim 20 wherein:

(i) the working zone has a centerline; and (ii) the platen drive system causes the line segment of contact to have multiple locations relative to the centerline.

26. The apparatus of claim 20 wherein:

(i) the working zone has a centerline; and (ii) the belt drive system causes the line segment of contact to have multiple locations relative to the centerline.

27. The apparatus of claim 26 wherein the belt drive system comprises oscillating rollers.

28. The apparatus of claim 20 wherein:

(i) the glass sheet lies in the Y-Z plane of an X,Y,Z coordinate system;

(ii) the linear edge has an orientation whereby it is either parallel to or at angle to the Z-axis of the X,Y,Z coordinate system; and (iii) the platen drive system causes the platen to adopt said orientation of the linear edge as the outer surface of the belt comes into contact with the linear edge.

29. The apparatus of claim 28 wherein the platen drive system comprises a plurality of air cylinders.

30. Apparatus for use with a glass sheet having a linear edge which is to be finished, said apparatus comprising:

(a) a belt assembly which comprises:

(i) a belt having an outer surface for removing glass from the linear edge and an inner surface; and (ii) a platen which contacts the belt's inner surface and defines a working zone for the belt;

(b) a belt drive system for rotating the belt; and (c) a platen drive system for moving the platen towards the linear edge of the glass sheet so as to create a line segment of contact between the outer surface of the belt and the linear edge;

wherein:

(i) the glass sheet and the working zone each define a plane;

(ii) said planes intersect at a line which contains the line segment of contact; and (iii) the platen drive system provides at least two orientations for the plane of the working zone relative to the plane of the glass sheet.

31. Apparatus for use with a glass sheet having a linear edge which is to be finished, said apparatus comprising:

(a) a belt assembly which comprises:

(i) a belt having al outer surface for removing glass from the linear edge and an inner surface; and (ii) a platen which contacts the belt's inner surface and defines a working zone for the belt;

(b) a belt drive system for rotating the belt; and (c) a platen drive system for moving the platen towards the linear edge of the glass sheet so as to create a line segment of contact between the outer-surface of the belt and the linear edge;

wherein:

(i) the working zone has a centerline; and (ii) the platen drive system causes the line segment of contact to have multiple locations relative to the centerline.

32. Apparatus for use with a glass sheet having a linear edge which is to be finished, said apparatus comprising:

(a) a belt assembly which comprises:

(i) a belt having an outer surface for removing glass from the linear edge and an inner surface; and (ii) a platen which contacts the belt's inner surface and defines a working zone for the belt;

(b) a belt drive system for rotating the belt; and (c) a platen drive system for moving the platen towards the linear edge of the glass sheet so as to create a line segment of contact between the outer surface of the belt and the linear edge;

wherein:

(i) the working zone has centerline; and (ii) the belt drive system causes the line segment of contact to have multiple locations relative to the centerline.

33. Apparatus for use with a glass sheet having a linear edge which is to be finished, said apparatus comprising:

(a) a belt assembly which comprises:

(i) a belt having an outer surface for removing glass from the linear edge and an inner surface; and (ii) a platen which contacts the belt's inner surface;

(b) a belt drive system for rotating the belt; and (c) a platen drive system for moving the platen towards the linear edge of the glass sheet to bring the outer surface of the belt into contact with the linear edge;

wherein:

(i) the glass sheet lies in the Y-Z plane of an X,Y,Z coordinate system;

(ii) the linear edge of the glass sheet has an orientation whereby it is either parallel to or at angle to the Z-axis of the X,Y,Z, coordinate system; and (iii) the platen drive system causes the platen to adopt the orientation of the linear edge as the outer surface of the belt comes into contact with the linear edge.

* * * * *